United States Patent [19]

Rimbert

[11] Patent Number: 4,565,234

[45] Date of Patent: Jan. 21, 1986

[54] CASTING PROCESS AND INSTALLATION FOR A NON-FERROUS METAL IN THE MOLTEN STATE

[75] Inventor: Jean F. Rimbert, Igny, France

[73] Assignee: L'Air Liquide, Societe Anonyme pour l'Etude et l'Exploitation des Procedes Georges Claude, Paris, France

[21] Appl. No.: 471,010

[22] Filed: Mar. 1, 1983

[30] Foreign Application Priority Data

Mar. 8, 1982 [FR] France ..... 82 03817

[51] Int. Cl.[4] ..... B22D 21/02

[52] U.S. Cl. ..... 164/66.1; 164/259; 164/323; 164/324

[58] Field of Search ..... 164/66.1, 259, 322–331

[56] References Cited

U.S. PATENT DOCUMENTS

| | | | |
|---|---|---|---|
| 1,978,222 | 10/1934 | Otte | 164/66.1 |
| 3,991,813 | 11/1976 | Andersson et al. | 164/259 |

FOREIGN PATENT DOCUMENTS

| | | | |
|---|---|---|---|
| 1262890 | 4/1961 | France . | |
| 1319216 | 1/1963 | France . | |
| 2165769 | 8/1973 | France . | |
| 2403849 | 4/1979 | France . | |
| 53-32829 | 3/1978 | Japan | 164/322 |
| 956865 | 4/1964 | United Kingdom . | |
| 2004784 | 4/1979 | United Kingdom . | |

*Primary Examiner*—Nicholas P. Godici
*Assistant Examiner*—Richard K. Seidel
*Attorney, Agent, or Firm*—Lee C. Robinson, Jr.

[57] ABSTRACT

The invention relates to casting non-ferrous metal from a storage vessel of the said molten metal into a receiving vessel of the said metal in the form of a gravity-free jet. According to the process, an isolating zone from the ambient air, covering the said receiving vessel and the said zone is rendered inert by introducing a liquified inert gas prior to and during casting. The process applies in particular to the continuous casting of zinc into ingots molds.

13 Claims, 2 Drawing Figures

CASTING PROCESS AND INSTALLATION FOR A NON-FERROUS METAL IN THE MOLTEN STATE

FIELD OF THE INVENTION

The subject of the invention is a casting process and installation in the form of a free-falling jet of a non-ferrous metal that could involve the problem of the formation of a solid metal scum at the point of impact of the jet cast metal. The invention applies more especially to casting zinc in ingot molds.

BACKGROUND OF THE INVENTION

It is well known how to attempt to protect the jet of the cast metal againt oxidation by the surrounding air when casting metals using an open jet. Among the numerous methods for protecting jets of cast metal used up to the present time, mention can be made of the process for casting metal in molds described in French Pat. No. 2,165,769, by virtue of which, on the one hand, the surface of the molten metal is made inert when it is heated up by injecting an inert gas through an injection rod passing through the top of the lid of the heating ladle containing the said metal and, on the other hand, previous inert gas injection into the mold into which the metal is to be cast. This process has the disadvantage that there is a risk of oxidation when the mold is transferred via the ambient air from its inert gas injection station to its casting station, and also during the casting operation as such.

This problem of protecting the casting jet occurs particularly acutely when casting non-ferrous metals which can form solid metal scums at the impact point of the jet cast metal, and more particularly when casting zinc in ingot molds.

It is generally a well-known fact that at any point where liquid zinc falls freely by gravity in a jet, and in particular when casting zinc in ingot molds, a solid metal scum forms at the point of impact of the jet of cast metal and then extends over the surface of the liquid contained in the ingot mold.

As is well known, the formation of this scum results from the oxidation of zinc. Bubbles are formed at the point of impact of a casting jet because of the high surface tension of zinc ($\simeq$780 dynes/cm). The air carried along with the jet brings about rapid surface oxidation by these bubbles. Since zinc oxide (melting point of ZnO$\simeq$1950° C.) is solid at the casting temperature (470° C. to 520° C.) and, in addition, its specific heat is substantially higher than that of zinc (ZnO: Cp=12 cal.mole$^{-1}$T$^{-1}$; Zn:Cp=7.5 cal.mole$^{-1}$ T$^{-1}$), the bubbles are immediately stabilized and solidified. The solid metal scum thus formed appears as a very fine foliated structure which contains about 98% metal and represents 1 to 1.5% of the cast metal.

In order to avoid faults caused by the oxides coming from this scum in the end-product zinc ingots, it is necessary to remove the surface layer of scum from the surface of the molten metal by manual skimming, generally with a metal scraper before the metal in the ingot mold is completely solid. Thus, in addition to the drawback of a not-inconsiderable loss of the original metal, the formation of zinc scum involves an investment in manpower and time which adversely affects the profitability of the whole process.

It is well known that, in order to avoid the formation of zinc scum, casting can be carried out in differently designed plants, such as plants using rising pouring techniques. But, as is also known, rising pouring is more costly and more difficult to operate than gravity casting.

SUMMARY AND OBJECTS OF THE INVENTION

The subject of this invention is a casting process for a molten non-ferrous metal that makes it possible to avoid the formation of solid metal scum in ordinary gravity casting plants.

The casting process where a jet of non-ferrous metal, in particular zinc, falls under gravity from a tank of the fed molten metal to a receiving container for the said metal in accordance with the invention is characterized in that at least one receiving vessel is covered by an isolating wall so as to form a zone isolating the metal from the ambient air, and the said isolating zone is previously rendered inert by introducing a liquefied inert gas into the said zone at a flow rate such that the air in the internal cavity of the said receiving vessel has an oxygen content of less than 1%, and preferably less than 0.1%, wherein the said receiving vessel fitted with the insulating wall is placed just below the molten metal storage tank and wherein a direct passage is made between the said storage tank and the receiving vessel so that the casting jet of molten metal runs through the isolation zone over its whole height, while maintaining the injection of liquefied inert gas in the upper part of the said isolating zone at a rate such that the atmosphere in the vicinity of the molten metal jet has a lower oxygen content than the values previously stated.

Another intention of the invention, is to cause a set of ingot molds, arranged transversely side-by-side, to pass under the said molten metal tank, each one of the metal molds being previously rendered inert before passing under the jet of molten metal. One operational method is to cover at least two adjacent ingot molds in the same set by the isolating wall.

The purpose of the invention also covers a non-ferrous metal casting plant using the process in question. This plant is characterized by the fact that it comprises:

a distribution tank with casting outlet, insulation means for insolating molten metal from the ambient air, integral with the said tank and around the said casting nozzle and extending downward so as to cover at least one receiving vessel, comprising means for supplying and distributing a liquefied inert gas connected to a liquefied inert gas storage tank.

As may be easily understood, the creation of the isolation zone with respect to the ambient environment and introduction of a liquified inert gas into this zone avoids any oxidation of the molten liquid metal and thus the formation of solid metal scum. This is because there is no stabilization nor solidification of the bubbles formed, which thus remain liquid and disappear from the metal bath. In this way, by means of the process in the invention, any loss of metal is avoided during casting and ingots are obtained that are free from scum at the end of the process.

The characteristics and advantages of the invention will appear in the following description, which is given for non-exhaustive reasons, and refers to the appended drawings in which.

Figure 1:
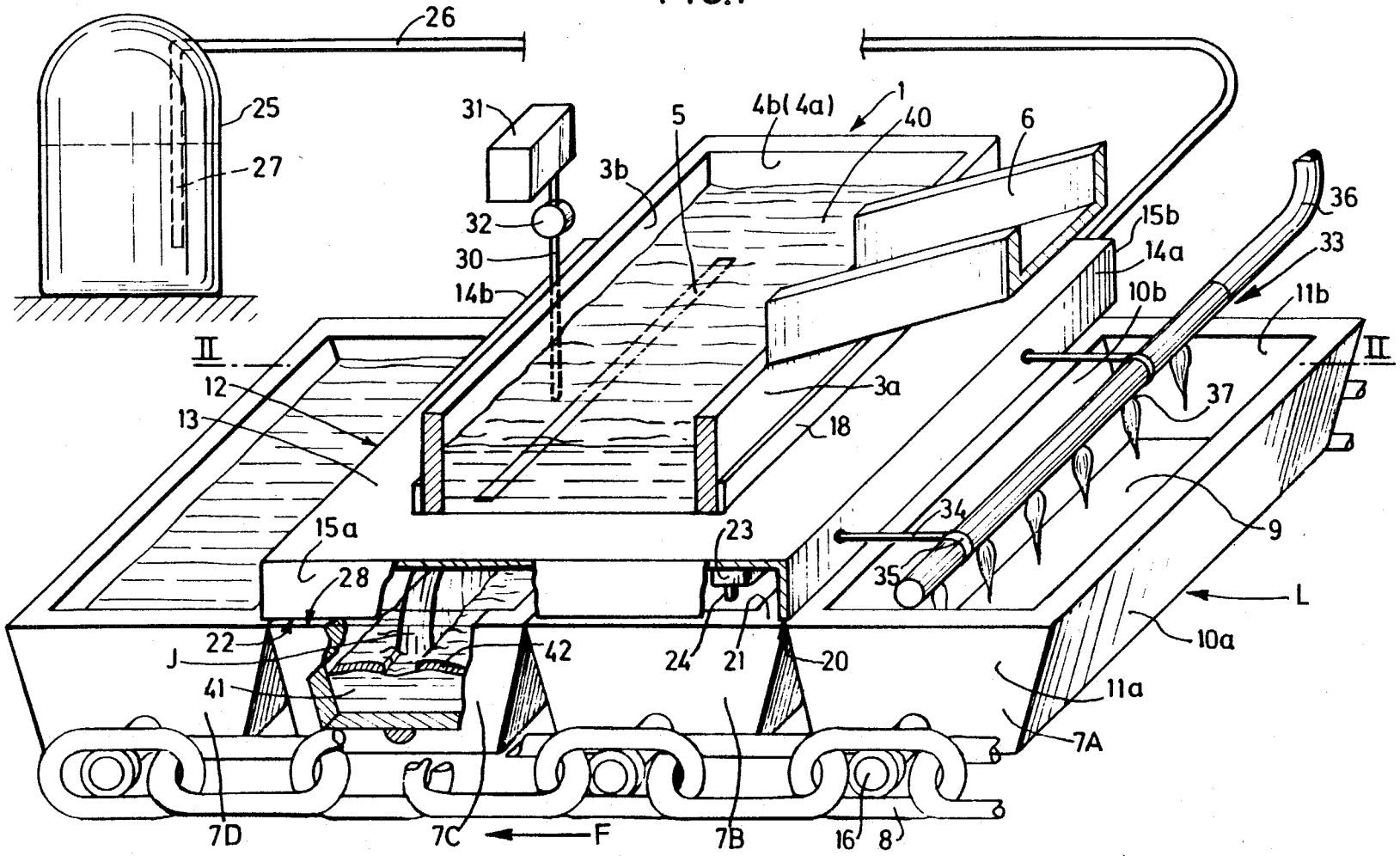
FIG. 1 is a perspective view of a non-ferrous metal casting plant in accordance with the invention.
Figure 2:
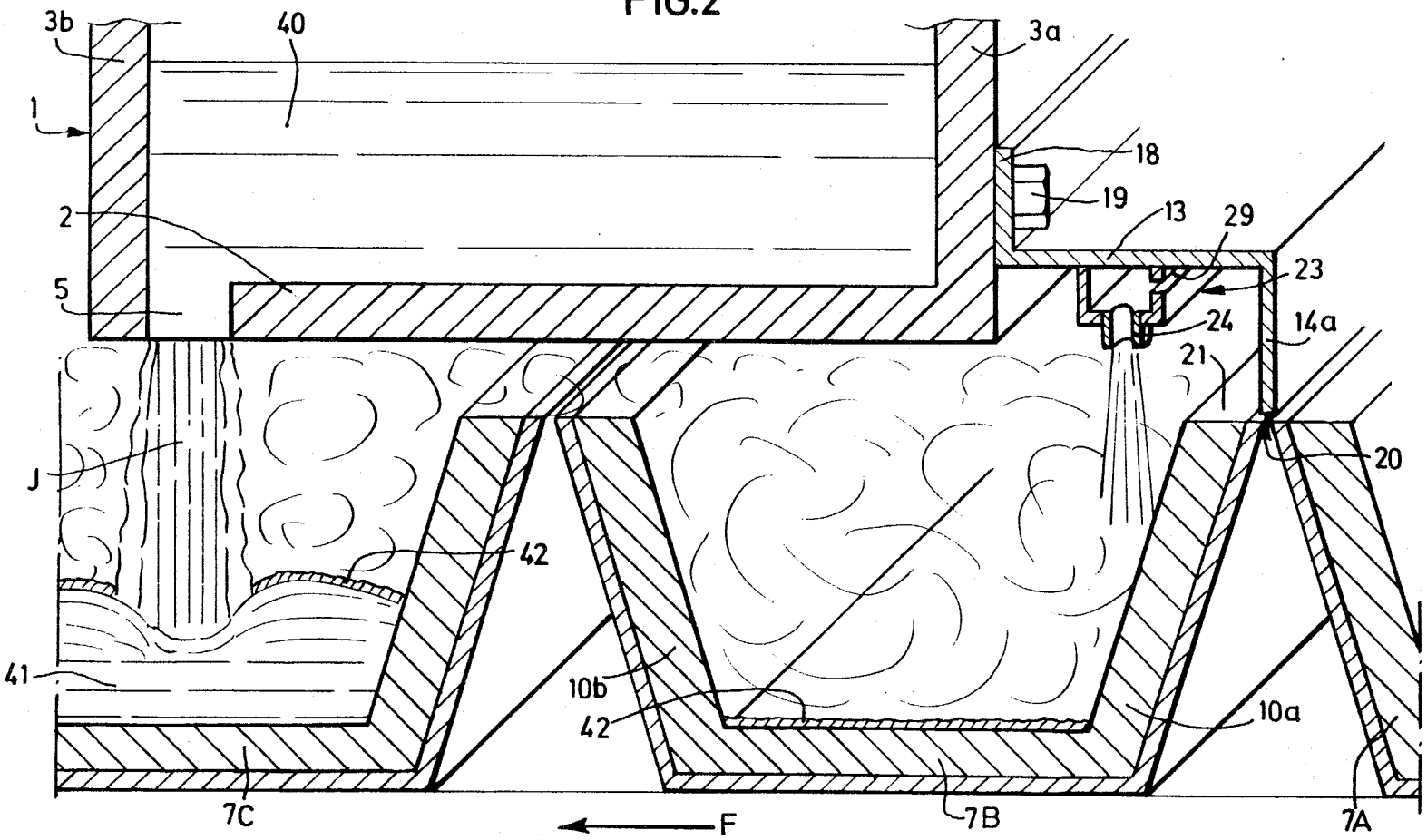
FIG. 2 is a partial, enlarged transverse section along II/II in FIG. 1.

Referring to FIGS. 1 and 2, a zinc casting plant comprises a metal distribution tank (1) in the form of a rectangular solid, comprising a bottom (2) and four side walls (3*a*, 3*b*) and (4*a*, 4*b*). The bottom (2) of the tank (1) comprises a slot (5). A spout (6) carries the incoming molten zinc and is connected to an intermediate heating furnace (not shown in the figure) and is slightly inclined, ending at the upper part of the wall (3*a*) of the distribution tank (1).

Metal ingot molds L, placed transversely side-by-side and integral with two endless transmission chains (8) via swivelling axles (16), move in the direction of arrow F under the distribution tank (1) and take up in turn positions (. . . 7A, 7B, 7C, 7D . . . ). These ingot molds L are trough-shaped with a rectangular bottom (9) and four slightly inclined side walls (10*a*, 10*b*) and (11*a*, 11*b*).

A metal cover (12), shaped as a rectangular section consists of an upper horizontal plate and four side vertical walls (14*a*, 14*b*) and (15*a*, 15*b*). The upper plate (13) has a rectangular opening cut in it with the correct dimensions so as just to contain the lower part of the distribution tank (1). Plate (13) of the cover (12) is fixed by means of four metal link plates (18) by means of bolts (19) to the walls (3*a*, 3*b*) and (4*a*, 4*b*) of the distribution tank (1).

Cover (12) completely covers the two ingot molds (7B) and (7C), and its side walls (14*a*, 14*b*) and (15*a*, 15*b*) reach just to the upper edges of these ingot molds. More precisely, the lower edge (20) of walls (14*a*, 14*b*) stops just above the upper edges (21) of walls (10*a*, 10*b*) of the ingot molds (7B) and (7C) and the lower edge (22) of sides (15*a*, 15*b*) stops just above the upper edges (28) of walls (11*a*, 11*b*) of ingot molds (7B) and (7C). Thus, cover (12) is a virtually hermetic protective lid for the internal cavity of the ingot molds (7B) and (7C), although it does not prevent them from moving along.

A supply and distribution manifold for a liquefied inert gas is fixed under the upper plate (13) parallel to the wall (14*a*) before the cover (12) with respect to the direction of movement F of the ingot molds L. This manifold (23) is of the conventional phase separator type, comprising a degasing slot (29) in its upper part and provided on its bottom section and regularly spaced out, with liquid inert gas injection nozzles (24) pointing downwards. The manifold (23) is connected to a liquified inert gas storage tank (25) by means of piping (26) and a descending tube (27). The supply and distribution manifold (23) should be preferably located before the cover (12) by reference to the direction of movement F, as shown in the figures, but it can also be placed after the cover (12); there can also be two liquid inert gas distribution and supply manifolds, one before and one after the cover.

A vertical pipe (30) runs through the front part of the upper plate (13) with respect to the direction of movement F and comes out slightly below the level of this plate (13). This pipe (13), fitted with a pump (32), is connected to an oxygen analyzer (31).

A pre-heating manifold (33), located parallel with the wall (14*a*) of the cover (12) and above the ingot mold (7A) is fixed to wall (14*a*) via metal rods (34) fitted with metal rings (35). This pre-heating manifold (33) consists of a pipe (36) connected to combustion gas and fuel gas supply sources (not shown in the figures), and provided at regular intervals with burners (37) pointing towards the inside cavity of the ingot mold (7A).

The distribution tank (1) contains a bath of molten zinc (14) which runs out via slot (5) in the form of a jet J in order to form a molten zinc bath (41) in the ingot mold (7C).

The installation as foreseen in the invention operates as follows. The distribution tank (1) is continuously supplied with molten zinc coming from an intermediate heating furnace by means of spout (6); impurities, in particular oxides formed when passing in contact with air in spout (6) remain on the surface of the molten metal bath (40), thus formed in the distribution tank (1) and the pure molten zinc is decanted from the bottom of the distributor (1) running through slot (5) in the ingot mold which is in position (7C).

By means of the chain (8), the ingot molds L are made to run under the cover (12) in the direction of arrow F. Before passing under cover (12), each ingot mold L, in the position (7A), is preheated to a temperature of $>100°$ C. by means of a pre-heating manifold. When this ingot mold L subsequently reaches position (7B), it is filled by jets of a liquified inert gas, such as argon or nitrogen, injected by nozzles (24) in the supply manifold (23). Part of this liquefied inert gas vaporizes and is distributed in the space enclosed by the cover (12) and the ingot molds in positions (7B) and (7C); the other part remains liquid and forms a liquid layer (42) on the bottom of the ingot mold (7B) which is found again at the surface of the metal bath (41) when the ingot mold gets to position (7C). In this way, an inert gaseous atmosphere is created in the internal cavity of ingot mold L in position (7B) as well as above the surface of bath (41) and around jet J in the following ingot mold (position (7C)). Afterwards, ingot mold L comes to position (7C) where it receives jet J of molten zinc and fills up little-by-little while being maintained within an inert gaseous atmosphere as has been explained previously. When the ingot mold L gets to position (7D), it contains a molten zinc bath the surface of which is exempt from solid metal scum.

Throughout the process, the oxygen content of the atmosphere around the casting jet J and the surface of the metal bath (41) is permanently monitored by means of the oxygen analyzer 31, and the liquified inert gas injection throughput is adjusted in the supply manifold (23) so that oxygen content is less than 1% and preferably less than 0.1%.

Any preheating of each ingot mold in position (7A) is intended, in certain cases, to avoid too great a cooling effect on this mold when it is in position (7B) as well as of the molten metal bath which it contains when it is in position (7C), such cooling coming from the negative calories supplied to the liquefied inert gas.

The invention applies more specifically to the continuous casting of zinc in ingot molds, but could also apply to the gravity casting of all non-ferrous metals which exhibit the problems of forming solid metal scums at the point of impact of the jet of cast metal, such as lead or alloys of lead and calcium, or zinc alloys.

I claim:

1. Process for gravity casting using a free jet of non-ferrous metal including zinc that can encounter the problem of a solid metal scum at the point of impact of the jet of cast metal coming from a storage reservoir of the molten metal to a receiving vessel for the same, the process comprising passing said receiving vessel under the molten metal storage reservoir, isolating the receiving vessel beneath the reservoir by covering the receiving vessel with an isolating wall so as to form a zone isolated from the ambient air, the receiving vessel being disposed directly below the molten metal storage reservoir so that there is a direct passage made between said storage reservoir and the receiving vessel such that the entire length of the molten metal casting jet is contained within the isolated zone, rendering said isolated zone inert by introducing into said zone an inert gas at a rate such that the atmosphere of an internal cavity of said receiving vessel has an oxygen content no greater than a predetermined subnormal oxygen content, said receiving vessel being rendered inert before passing under the molten metal jet, and maintaining the injection of said inert gas at a rate such that the atmosphere in the vicinity of said molten metal jet has an oxygen content less than said predetermined subnormal oxygen content.

2. Procedure according to claim 1, wherein a set of ingot molds, positioned transversely side-by-side, are caused to pass under the said molten metal storage tank and wherein each of the ingot molds is previously rendered inert before passing under the molten metal jet.

3. Process according to claim 1, wherein said subnormal oxygen content is maintained at less than 1%.

4. Process according to claim 1, wherein said subnormal oxygen content is maintained at less than 0.1%.

5. Metal casting apparatus for the gravity casting of non-ferrous metal including zinc that can encounter the problem of a solid metal scum at the point of impact of the jet with a receiving vessel therefor, the apparatus comprising a distribution tank containing the molten metal and having a casting outlet disposed in a bottom thereof;

means for driving and guiding at least one receiving vessel underneath the distribution tank;

isolating means integral with the distribution tank and arranged around the casting outlet and extending downwards so as to cover said at least one said receiving vessel for covering said vessel and forming a zone isolated from the ambient air, the isolated receiving vessel being disposed to pass under the casting outlet so that there is a direct passage made between said distribution tank and the receiving vessel such that the entire length of the molten metal casting jet is contained within the isolated zone; and means for supplying and distributing an inert gas into said isolated zone for rendering said isolated zone inert by introducing said inert gas into said zone at a rate such that the atmosphere of an internal cavity of said receiving vessel has an oxygen content no greater than a predetermined subnormal oxygen content, said means for supplying and distributing said inert gas including means rendering said vessel inert before the latter passes under the molten metal jet and maintaining the injection of said inert gas at such a rate that the atmosphere in the vicinity of said molten metal jet has an oxygen content less than said predetermined subnormal oxygen content.

6. Apparatus according to claim 5, wherein the means of supplying and distributing an inert gas is connected to a source of liquefied inert gas and includes a supply and distribution manifold of a type which forms a phase separator with a liquid discharge orifice in a bottom section thereof and gas discharge orifices in an upper section thereof, placed within said means of insulation.

7. Apparatus according to one of the claims 5 or 6, further comprising means of driving and guiding (8) a set of receiving vessels (L) arranged transversely side-by-side, one after the other, and capable of moving under said means of insulation (12).

8. Apparatus according to claim 7, further comprising preheating means (33) before the molten metal storage tank (1) by reference to the direction of movement of the said series of vessels.

9. Apparatus according to either one of the claims 1 and 6 further comprising means for measuring the oxygen content (31) within the isolating means (12) in the vicinity of the distribution tank casting outlet (1).

10. Apparatus according to claim 5 or 6, wherein the isolating means includes a metal cover in the form of a rectangular solid of which an upper horizontal plate incorporates a rectangular opening having dimensions which are just large enough to fit onto the lower part of the distribution tank and having four vertical plates which descend from the horizontal plate substantially to upper edges of at least one of the receiving vessels.

11. Process for gravity casting using a free jet of non-ferrous metal including zinc that can encounter the problem of a solid metal scum at the point of impact of the jet of cast metal coming from a storage reservoir of the molten metal to an ingot mold serving as a receiving vessel for the same, the process comprising positioning a set of ingot molds transversely side-by-side, passing said ingot molds serially under the molten metal storage tank, isolating at least two adjacent said ingot molds by covering the same by an isolating wall so as to form a zone isolated from the ambient air, wherein at least two adjacent ingot molds in the set are covered at any one time by the isolating wall, placing the ingot molds with the isolating wall directly below the molten metal storage reservoir so that there is a direct passage made between said storage reservoir and the ingot molds such that the molten metal casting jet passes through the isolated zone over its entire length, rendering said isolated zone inert by introducing into said zone an inert gas at a rate such that the atmosphere of an internal cavity of each said ingot mold has an oxygen content no greater than a predetermined subnormal oxygen content, the ingot molds being rendered inert before passing under the molten metal jet, and maintaining the injection of said inert gas at a rate such that the atmosphere in the vicinity of said molten metal jet has an oxygen content less than said predetermined subnormal content.

12. Process according to either one of the claims 2 or 11, wherein each of the ingot molds is preheated before passing into the isolating zone.

13. Process according to one of the claims 2, 11 or 1, wherein the inert gas is nitrogen or argon.

* * * * *